US005180899A

United States Patent [19]

Inasaki

[11] Patent Number: 5,180,899

[45] Date of Patent: Jan. 19, 1993

[54] FIXING UNIT FOR PICTURE IMAGE FORMING EQUIPMENT HAVING A THREE LAYERED FIXING ROLLER

[75] Inventor: Yutaka Inasaki, Saitama, Japan

[73] Assignee: Fuji Xerox Co., Ltd., Tokyo, Japan

[21] Appl. No.: 603,009

[22] Filed: Oct. 25, 1990

[30] Foreign Application Priority Data

Nov. 8, 1989 [JP] Japan ..... 1-130190

[51] Int. Cl.[5] ..... G03G 15/20

[52] U.S. Cl. ..... 219/469; 219/216; 355/285; 355/290

[58] Field of Search ..... 29/130, 132; 355/282, 355/285, 289, 290, 295; 219/216, 469

[56] References Cited

U.S. PATENT DOCUMENTS 3,913,521 10/1975 Bar-on ..... 118/60
4,640,600 2/1987 Hirabayashi et al. ..... 355/290
4,883,715 11/1989 Kuge et al. ..... 29/132 X

FOREIGN PATENT DOCUMENTS 0023072 2/1983 Japan .
0052580 3/1987 Japan .
0086383 4/1987 Japan ..... 355/290
293271 12/1987 Japan .
0237084 10/1988 Japan ..... 355/290

*Primary Examiner*—A. T. Grimley
*Assistant Examiner*—J. E. Barlow, Jr.
*Attorney, Agent, or Firm*—Finnegan, Henderson, Farabow, Garrett and Dunner

[57] ABSTRACT

A fixing unit for picture image forming equipment including a heating roller and a pressure roller, fixes unfixed picture images formed on paper by applying heat thereto. The fixing unit for a picture image forming equipment includes a pressure roller having a structure consisting of three layers, namely, a silicone sponge layer, a silicone rubber layer, and a relatively hard tubular layer, which are arranged in the stated order outwards from the central part to the outermost shell. The tubular layer is a tetrafluoroethylene fluorocarbon polymer layer having a thickness in the range from 30 μm to 70 μm. The silicone sponge layer has a thickness in the range of 50% to 60% of the outside diameter of the pressure roller.

3 Claims, 2 Drawing Sheets

FIXING UNIT FOR PICTURE IMAGE FORMING EQUIPMENT HAVING A THREE LAYERED FIXING ROLLER

BACKGROUND OF THE INVENTION

The present invention relates to picture image forming equipment, such as a copying machine, a facsimile machine, or a printer, of the type generally used in an electrostatic recording process, which consists of forming an electrostatic latent image on an image carrier, such as a photosensitive material and then obtaining or "developing" a picture image by converting such an electrostatic latent image into a visible image. The present invention relates more particularly to improvements of a fixing unit, which fixes a yet unfixed, developed picture image by applying a heating process thereto.

FIG. 3 illustrates a perspective view of a conventional fixing unit 1.

This fixing unit 1 is comprised of a heating roller 2, which has a heating source such as a lamp light source (not shown in FIG. 3) set therein, and a pressure roller 3, which contacts the heating roller 2 under pressure. In a photosensitive material and developing unit, not shown in FIG. 3, a toner image (a picture image) not yet fixed is formed on paper, and the paper is subsequently transported to the fixing unit 1, which fixes the toner image on the paper by heat from the heating roller 2 while it transports the paper between the heating roller 2 and the pressure roller 3.

Moreover, in FIG. 3, the reference number 8, indicates a cleaner made of felt which wipes off excess toner sticking to the circumferential area of the heating roller 2. The reference number 4 indicates a plate spring, which applies pressure to the cleaner 8 to keep it in contact with the circumferential surface of the heating roller 2. Reference number 5 indicates a heat cover, which is designed to secure the thermal insulation of the fixing unit 1.

In still further detail, the conventional fixing unit 1 described above is provided with the pressure roller 3 in a unified structure made of silicone rubber 6, as illustrated in the enlarged cross-sectional view of the relevant parts in FIG. 4. Consequently, the pressure roller 3 has a comparatively high degree of hardness as a whole.

The conventional fixing unit 1 described above, having pressure roller 3 is made of a unified structure of silicone rubber 6, because it undergoes a rapid aging change and consequently has a short service life.

Also, the pressure roller 3 thus made in a substantially monolithic structure of silicone rubber 6 is subject to a deformation of its surface. During this deformation, the part of the surface of the pressure roller 3 which is in contact with the paper has such a considerable pressure variation in the width direction of the paper while the fixing unit transports the paper between the heating roller 2 and the pressure roller 3 that a difference in the paper transporting speed causes deformation of the surface of the pressure roller 3 and wrinkles in the paper.

Moreover, since the pressure roller 3 is formed of silicone rubber 6, the pressure roller has the roller likely to collect the toner on its surface and to be smeared with such toner.

Furthermore, since the conventional fixing unit 1 is provided with a pressure roller 3 which is formed of a unified structure of silicone rubber 6 which has a high degree of hardness as a whole, the pressure roller 3 can hardly achieve adequate contact with the heating roller 2. As a result, the conventional fixing unit 1 that it cannot produce fixed images of high picture quality from the yet unfixed toner images formed on the paper by bringing such images into a sufficiently close and uniform contact with the heating roller 2.

SUMMARY OF THE INVENTION

The present invention has been made, in view of the abovementioned circumstances, with the object of offering a fixing unit which achieves improvements of the service life of the heating roller prevents the occurrence of wrinkles on the paper to the maximum extent attainable, inhibits the sticking of soil on the paper, and further improves the fixing performance in processing toner images.

In order to attain the objects mentioned above, the present invention proposes a construction of the heating roller in three layers. Namely, a silicone sponge layer, a silicone rubber layer, and a tubular layer of TEFLON®,[1/] or a TEFLON-like material, which are arranged in the stated order from the central part outwards to the outermost shell of the heating roller. TEFLON-like materials comprise, among others, tetrafluoroethylene fluorocarbon polymers.

[1/] TEFLON is a registered trademark of E.I. duPont deNemours & Co.

The minimum requirement for the TEFLON-like material layer is that it have a much greater hardness than the silicone rubber.

With the pressure roller having the construction of the three layers as described above, the deformation of the roller is absorbed by the silicone sponge layer while elastic force is given to the roller by the silicone rubber layer. Further, the deformation of the outside diameter and the soiling of the roller are prevented to the maximum extent possible by the tubular layer. Furthermore, the construction of the three layers described above produces the effect of setting the hardness of the pressure roller as a whole at a relatively low level, as compared to a silicone rubber roller.

BRIEF DESCRIPTION OF THE DRAWINGS

The manner in which the above-mentioned objects, features and advantages of the present invention are attained will be fully evident from the following detailed description when it is considered in light of the drawings, wherein.

DETAILED DESCRIPTION OF THE INVENTION

In the description to follow, one example of a preferred embodiment of the present invention is described. It should be understood, however, that the present invention is not limited to such examples of its embodiment, but may be applied effectively to other embodiments to such an extent as will not deviate from its scope, as defined for the present invention by the appended claims and their equivalents.

Figure 1:
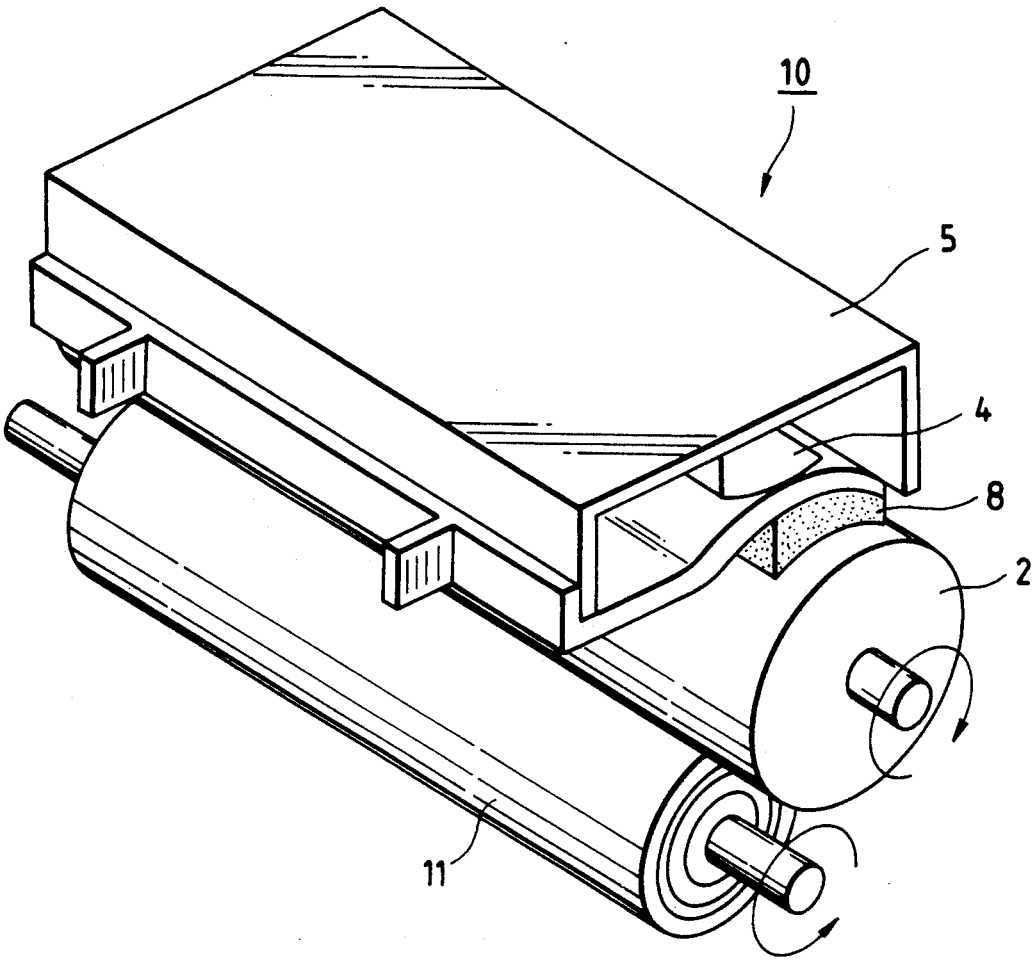
FIG. 1 is a perspective view of the fixing unit according to the present invention.
Figure 3:
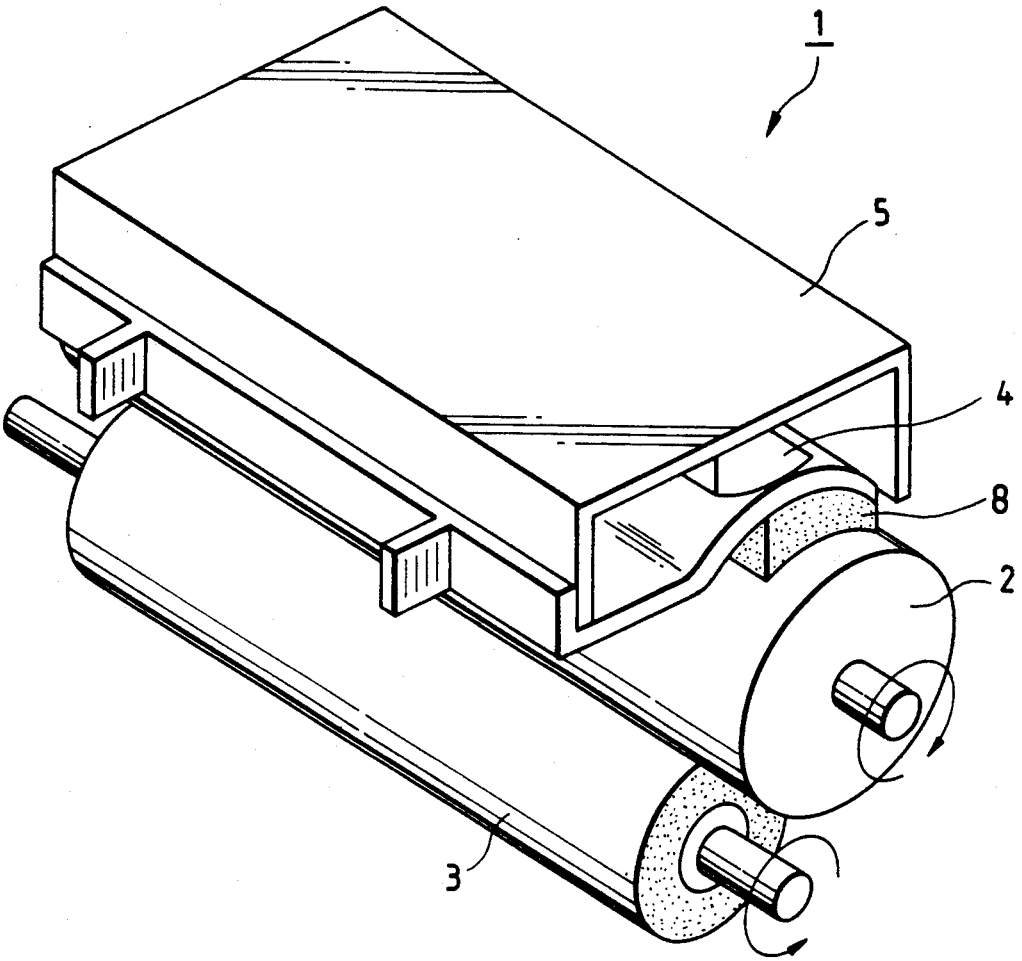
FIG. 3 PRIOR ART
FIG. 3 is a perspective view of the fixing unit according to the prior art.
Figure 4:
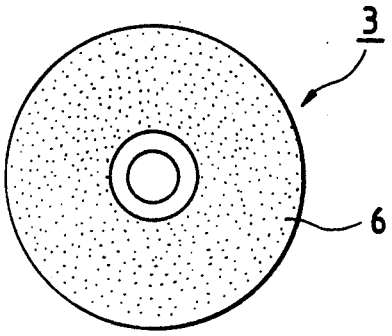
FIG. 4 PRIOR ART
FIG. 4 is an enlarged cross-sectional view of the pressure rollers of the conventional fixing unit shown in FIG. 3.

FIG. 1 is a conceptual perspective view of the fixing unit 10 according to the present invention, and the same component parts as those shown in FIG. 3 are indicated by the same reference numbers in FIG. 1.

Figure 2:
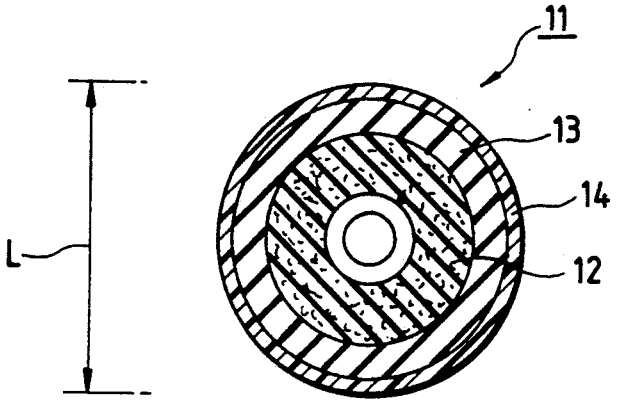
FIG. 2 is a cross-sectional view illustrating the pressure roller of FIG. 1.

In this fixing unit 10, a pressure roller 11, which is kept in contact under pressure with a heating roller 2, is formed of a structure consisting of three layers respectively made of different materials, as shown in the enlarged sectional view of FIG. 2.

Pressure roller 11 is composed of a silicone sponge layer 12, which has a low degree of hardness, a silicone rubber layer 13, and a TEFLON tube layer 14 arranged in the stated order from the central part to the outermost shell. Of these layers, the silicone sponge layer 12 has a thickness such that it occupies approximately 50 to 60 per cent of the outside diameter L of pressure roller 11. The silicone rubber layer 13 has a thickness such that its diametral occupancy is in a range from approximately five to approximately thirty per cent of the outside diameter L of the pressure roller 11. The TEFLON tube layer 14, which is arranged as the outermost shell, has a thickness in the range from approximately 30 μm to approximately 70 μm.

With the pressure roller 11 in the three-layer construction described above, the silicone sponge layer 12, which has the largest thickness of all the layers and is soft, absorbs the deformation of the roll diameter L and also achieves a very considerable reduction of the hardness of the pressure roller as a whole in comparison with the conventional pressure roller made of silicone rubber only. Therefore, the pressure roller according to the present invention is capable of producing high-quality toner images through improvement on the fixing function of the fixing unit in processing the toner images formed on the paper by securing a sufficiently thorough and uniform contact of the paper with the heating roller 2. In addition, the silicone rubber layer 13, which has a degree of hardness higher than layer 12, gives elastic force to the pressure roller 11. Furthermore, the TEFLON tube layer 14, which is less subject to aging changes and less likely to collect soil, works to prevent the surface deformation of the pressure roller 11 and its collection of soil as much as possible. The construction of the pressure roller according to the present invention therefore prevents the occurrence of wrinkles on the paper as much as possible and additionally extends the service life of the pressure roller 11 as a whole.

In summary, the fixing unit according to the present invention is provided with a pressure roller constructed of a structure consisting of three layers, namely, a silicone sponge layer, a silicone rubber layer, and a relatively hard tubular layer, which are arranged in the stated order outwards from the central part to the outermost shell of the pressure roller. The silicone sponge layer absorbs the deformation of the outside diameter of the roller, the silicone rubber layer gives elastic force to the roller, and further the relatively hard tubular layer prevents the relative deformations of the outside diameter of the roller and the collection of soil thereon as much as possible. Owing to these advantageous effects, the construction of the fixing unit according to the present invention can prolong the service life of the pressure roller and also prevent as much as possible the occurrence of wrinkles on the paper and the collection of such soiling substance as toner on the pressure roller. Furthermore, since the fixing unit according to the present invention offers a pressure roller in a construction formed with the radial variation as described above, the pressure roller can be made with its overall hardness set at an extremely low level in comparison with the hardness of the conventional pressure roller and consequently improves its contact with the heating roller, thereby achieving improvements of the fixing effect of toner image and thus offering fixed images of high quality.

What is claimed is:

1. A fixing unit for picture image forming equipment, comprising:

a heating roller;

a pressure roller contacting said heating roller along a pressure line, said pressure roller having at least three layers including an innermost silicone sponge layer, an intermediate silicone rubber layer and an outer polytetrafluoroethylene layer;

means for creating pressure between the rollers along the pressure line, wherein said innermost silicone sponge layer has a thickness in the range of 50 to 60 percent of the outside diameter of the pressure roller.

2. The fixing unit of claim 1, wherein the intermediate silicone rubber layer has a thickness in the range of 5 to 30 percent of the outside diameter of the pressure roller.

3. The fixing unit of claim 1, wherein the outer polytetrafluoroethylene layer has a thickness in the range of 30 μm to 70 μm.

* * * * *